US005957747A

United States Patent [19]

Liggitt

[11] Patent Number: 5,957,747

[45] Date of Patent: Sep. 28, 1999

[54] MUSICAL RELIGIOUS DOLL AND SINGING BIBLE NIGHTLIGHT

[76] Inventor: Toni A. Liggitt, 9620 Lindenbrook St., Fairfax, Va. 22031

[21] Appl. No.: 09/033,804

[22] Filed: Mar. 3, 1998

Related U.S. Application Data

[60] Provisional application No. 60/039,855, Mar. 5, 1997.

[51] Int. Cl.[6] ..... A63H 3/28

[52] U.S. Cl. ..... 446/297; 446/268; 446/73; 446/485

[58] Field of Search ..... 446/72, 73, 81, 446/297, 268, 485; 63/19

[56] References Cited

U.S. PATENT DOCUMENTS

| | | | |
|---|---|---|---|
| D. 73,258 | 8/1927 | Heard | 446/73 |
| D. 313,446 | 1/1991 | Froutzis . | |
| 1,445,368 | 2/1923 | Street et al. . | |
| 1,621,157 | 3/1927 | Du Bois . | |
| 1,824,316 | 9/1931 | Wilhelm . | |
| 2,479,790 | 8/1949 | Strumor . | |
| 2,932,917 | 4/1960 | Patane | 446/392 |
| 3,234,687 | 2/1966 | Elwell . | |
| 4,124,022 | 11/1978 | Gross | 446/397 |
| 4,638,409 | 1/1987 | Berman . | |
| 4,878,871 | 11/1989 | Noto . | |
| 4,912,608 | 3/1990 | Lee . | |
| 4,947,722 | 8/1990 | Lewis . | |
| 4,950,200 | 8/1990 | Curran . | |
| 5,059,149 | 10/1991 | Stone . | |
| 5,094,621 | 3/1992 | Friedel | 446/73 |
| 5,456,625 | 10/1995 | Dumond . | |
| 5,842,900 | 12/1998 | Hodge | 446/73 |

FOREIGN PATENT DOCUMENTS 2222093 2/1990 Russian Federation .

*Primary Examiner*—Robert A. Hafer
*Assistant Examiner*—Jeffrey D. Carlson
*Attorney, Agent, or Firm*—Richard C. Litman

[57] ABSTRACT

A doll in the likeness of The Lord Jesus clothed in a white silky robe, with a red silky sash and brown leather-like sandals. A heart shaped locket is attached to the chest of the doll at a point which approximates the location of the doll's heart. The locket includes a central portion which lies inside the doll body and flush with the chest of the doll, and a cover hingedly connected to the central portion where it is exposed. The cover of the locket is optionally padded and covered in the same material as the sash. The body of the doll is made of a soft and pliable material. Opening the locket cover reveals a picture (e.g., the intended user) and on the back of the locket cover is the inscription "Jesus Loves". Additionally, a switch is closed upon the opening of the cover and an audio mechanism located in central portion of the locket plays music such as the song "Jesus Loves Me". The doll in combination with a nightlight provides a similar effect. Upon closing of the locket or activating the a switch in the base of the lamp, the respective switches open and the audio mechanisms shuts off.

11 Claims, 7 Drawing Sheets

MUSICAL RELIGIOUS DOLL AND SINGING BIBLE NIGHTLIGHT

CROSS-REFERENCE TO RELATED APPLICATION

This application claims the benefit of U.S. Provisional patent application Ser. No. 60/039,855, filed Mar. 5, 1997.

BACKGROUND OF THE INVENTION

1. Field of the Invention

The present invention relates to dolls or figurines equipped with a music source. More specifically, the present invention relates to a doll that includes a locket and combination nightlight having switches which when opened activate an audio mechanism to play an uplifting song.

2. Description of Relevant Art

Dolls are well known as exemplified by the large quantity and diversity of dolls described within the prior art. All dolls inspire a unique sentiment in those that behold them. While mere appearance and tactility may count for much of the developed affinity toward a particular doll, other features can create equally intense feelings of adoration. In general, these other features are most often directed toward establishing interaction between the doll and it's intended user. For example, the interaction may be "role-playing" for which the doll may have the appearance of an infant and include the feature of "wetting". While interacting with such a doll, the user (usually a child) assumes the role of parent and performs the duty of "changing". The user may enjoy the doll because of the role played while interacting with the doll, rather than the appearance of the doll.

Establishment of affinity toward a doll may be indirect and involve the incorporation of features or effects that already appeal to the intended user. For example, U.S. Pat. No. 1,445,368, issued to John A. Street et al., on Feb. 13, 1923, shows a doll having at the heart spot a means to mount a picture, miniature, or keepsake, whereby an ornamental article may be provided which appeals to the sentiments. The heart has long been the symbolic source of affection and likely chosen as the location of the sentimental item in order to impart the notion that whatever is held within the heart shaped locket is the subject of adoration for the doll.

Sounds may also be used to attract the affinity of the intended user. U.S. Pat. No. 1,824,316, issued to John H. Wilhelm on Sep. 22, 1931, shows a doll with a sound producing device. Assuming that the sounds produced by the device are pleasing to the intended user, an increased affinity toward the doll may be realized since the doll is the apparent source of the pleasing sound. U.S. Pat. No. 1,621,157, issued to Harry D. Du Bois on Mar. 15, 1927, discloses a musical doll wherein the sound producing instrument is activated by pressing the doll body in the region having the instrument cover. The added feature of control, by the intended user, over the production of sound by the doll simulates an apparent responsiveness and as such the interaction may be endearing to an intended user. U.S. Pat. No. 2,479,790, issued to Mathew A. Strumor on Aug. 23, 1949, discloses a manually operated sound reproduction device mounted in toy animals, dolls, etc. The sound to be produced may be a sound particularly characteristic of the toy figure in which the device is mounted. While the patent to Strumor is substantially similar to that of Du Bois, the use of actual recordings lends an authenticity to the notion that the toy figure is indeed the source of the sound.

A combination of interactive features are illustrated by the following U.S. Patents; U.S. Pat. No. 3,234,687, issued to Charles Elwell on Feb. 15, 1966, which discloses a doll having a sound producing device adapted to reproduce sounds typical of the toy figure in response to manipulations of the user in the same manner as would be required to produce the same or similar sounds from a live figure. U.S. Pat. No. 4,878,871, issued to Nancy C. Noto on Nov. 7, 1989, discloses a toy that utilizes a cavity containing a cassette player for conveying a personalized message from a sender to a recipient. The toy may be fashioned in the general likeness of the sender and, therefore, the toy may appeal to the intended user more than an unrecognizable figure would. U.S. Pat. No. 4,950,200, issued to Kenneth J. Curran on Aug. 21, 1990, discloses a doll containing an endless loop tape deck having multiple tracks speaking in a normal tone and volume when a switch in its hand is closed and in a whisper tone and volume when a switch in its chest, in the general area of the heart, is closed. The selective nature of the type of message and its delivery imply differing levels of intimacy while interacting with this particular doll and begs the question of affinity with the establishment of intimacy. Each of the aforementioned features is intended to increase an affinity toward a particular doll or toy figure through interaction thereby and therewith. U.S. Pat. No. 5,059,149, issued to Timothy J. Stone on Oct. 22, 1991, shows a stuffed animal with book enclosure apparatus. Locating a book within a figurine is more likely an attempt at the reverse of those intentions previously described herein. Love of reading is more likely to be the intended goal than to be the source of an association with such an already established and likely recipient of adoration as is the so called "teddy bear" stuffed animal toy.

None of the prior art dolls show the combination of a heart shaped locket adapted for holding a picture of the intended user, a locket wherein the opening and closing of the cover acts to switch on and off a sound producing device that plays music, such as the song "Jesus loves me", and a doll in the likeness of The Lord Jesus. In addition the prior art fails to teach or suggest the doll used in combination with a nightlight or nightstand as herein described.

Thus, none of the above inventions and patents, taken either singly or in combination, is seen to describe the instant invention according to a preferred embodiment as claimed.

SUMMARY OF THE INVENTION

The present invention is a doll in the likeness of The Lord Jesus clothed in a white silky robe, with a red silky sash and brown leather-like sandals. A heart shaped locket is attached to the chest of the doll at a point which approximates the location of the doll's heart. The locket includes a central portion which lies inside the doll body and flush with the chest of the doll, and a cover hingedly connected to the central portion where it is exposed. The cover of the locket preferably is padded and covered in the same material as the sash. The body of the doll preferably is soft and pliable. Opening the locket cover reveals a picture (e.g., the intended user) and on the inside or back of the locket cover is the inscription "Jesus Loves".

Additionally, a switch is closed upon the opening of the cover and an audio mechanism located in the central portion of the locket plays uplifting music such as the song "Jesus loves me". Upon closing of the locket, the switch opens and the audio mechanism shuts off. A nightlight in combination with the doll is a variation of the instant invention which provides a similar effect as described by the locket, except that the switch mechanism for activating an audio mechanism is disposed in the base of the nightlight.

Accordingly, it is a principal object of the invention to provide a doll that is in the general likeness of The Lord Jesus and includes a heart shaped locket adapted for holding a picture and playing music upon opening.

It is another object of the invention to engender a specific predilection toward The Lord Jesus in the notion that the beholder of the doll is beheld and loved by The Lord Jesus.

It is a further object of the invention to provide a heart shaped locket with a battery operated audio mechanism.

Still another object of the invention is to provide an interactive doll that appeals to the sentiments of its intended user.

Further still, it is an object of the invention to provide an interactive doll and nightlight that appeals to the sentiments of its intended user.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
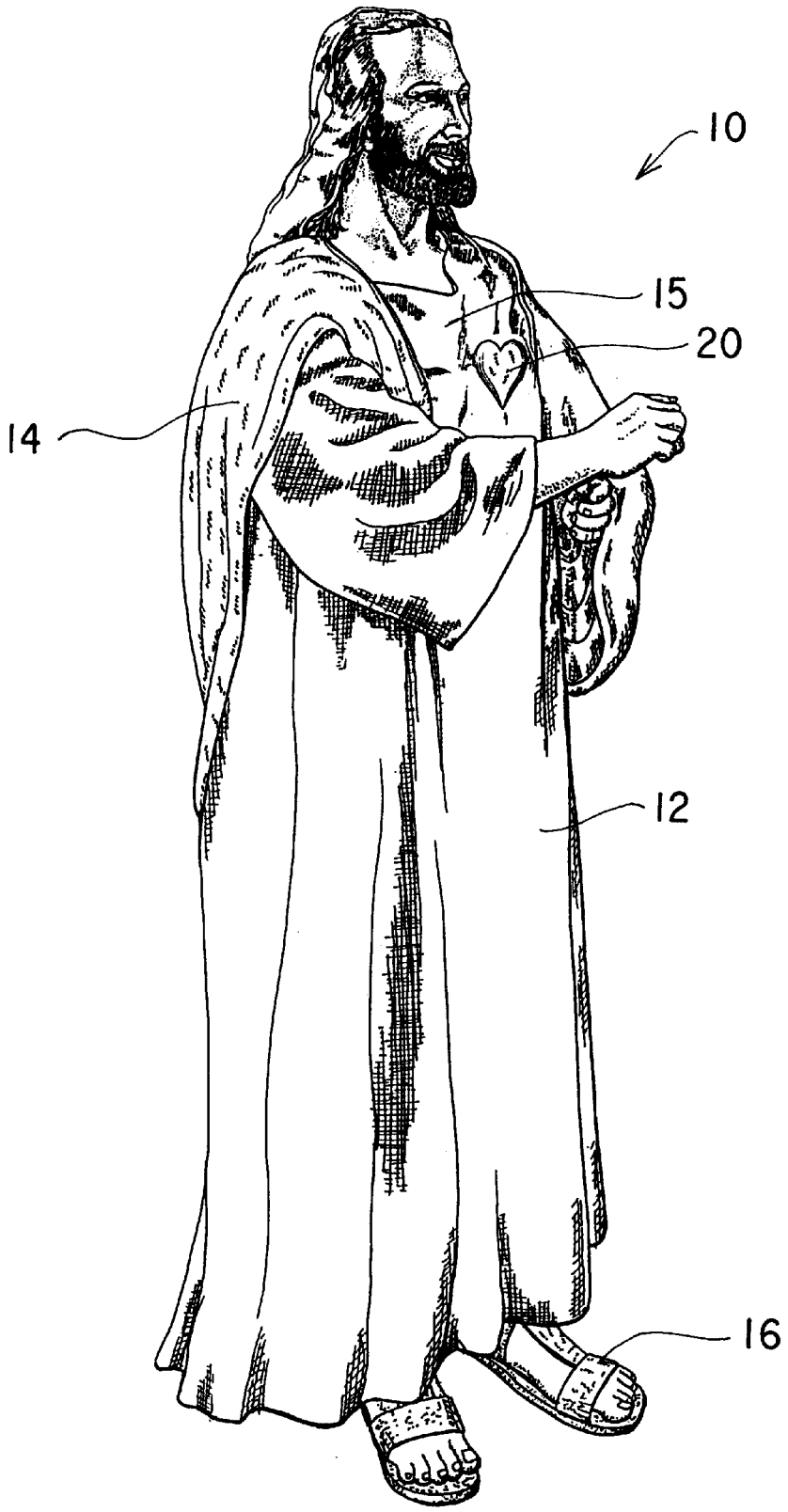
FIG. 1 is an environmental, perspective view of the musical religious doll according to the present invention.

In a first embodiment of the invention, FIGS. 1–4 diagrammatically illustrates a doll 10 in the likeness of The Lord Jesus clothed in a white silky robe 12, with a red silky sash 14 and brown leather-like sandals 16. A heart shaped locket 20 is attached to the chest 15 of the doll at a point which approximates the location of the doll's heart.

Figure 2:
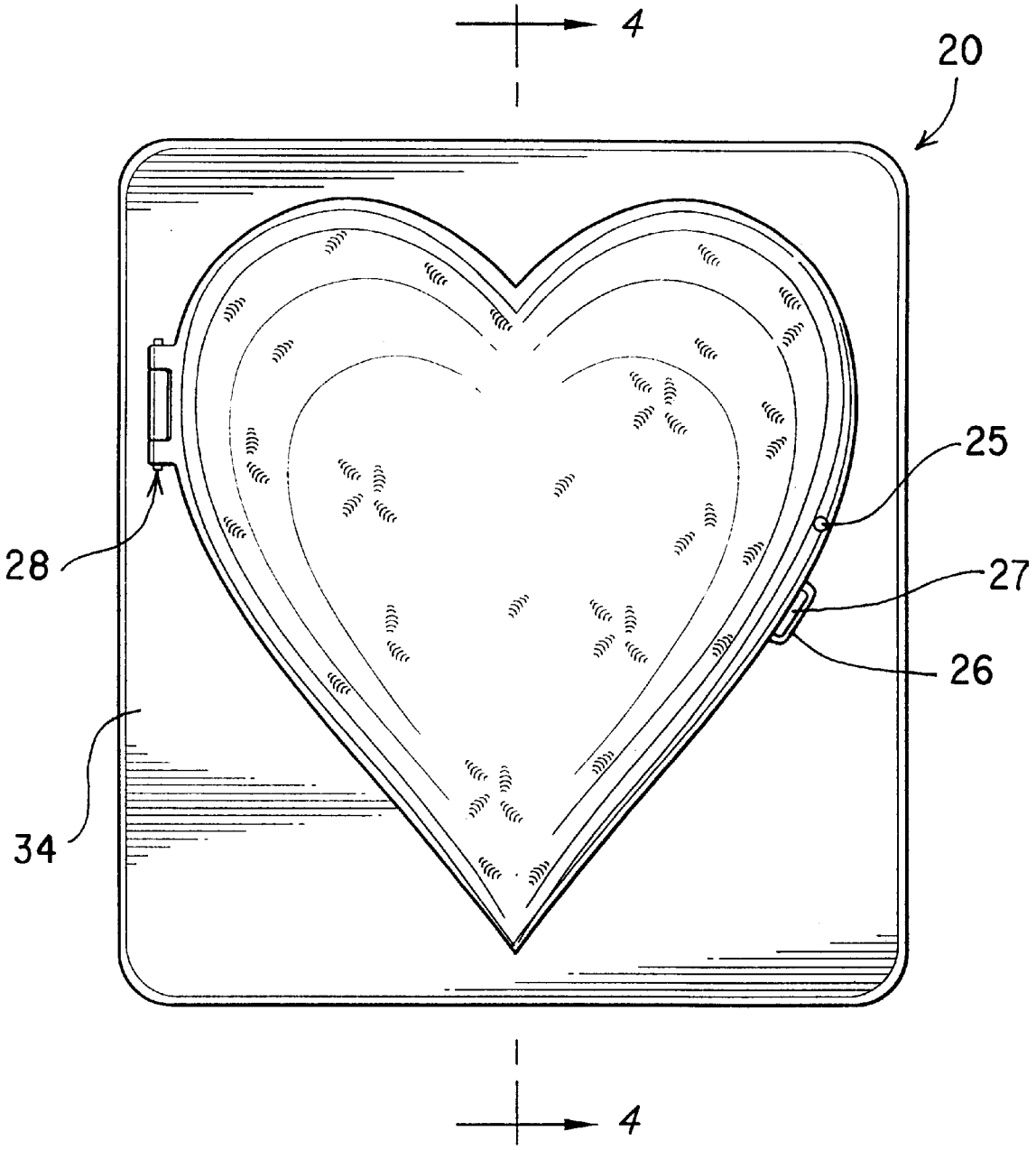
FIG. 2 is a top plan view of a closed, heart shaped musical device which is inserted into the chest region of the body of a doll according to the present invention.
Figure 3:
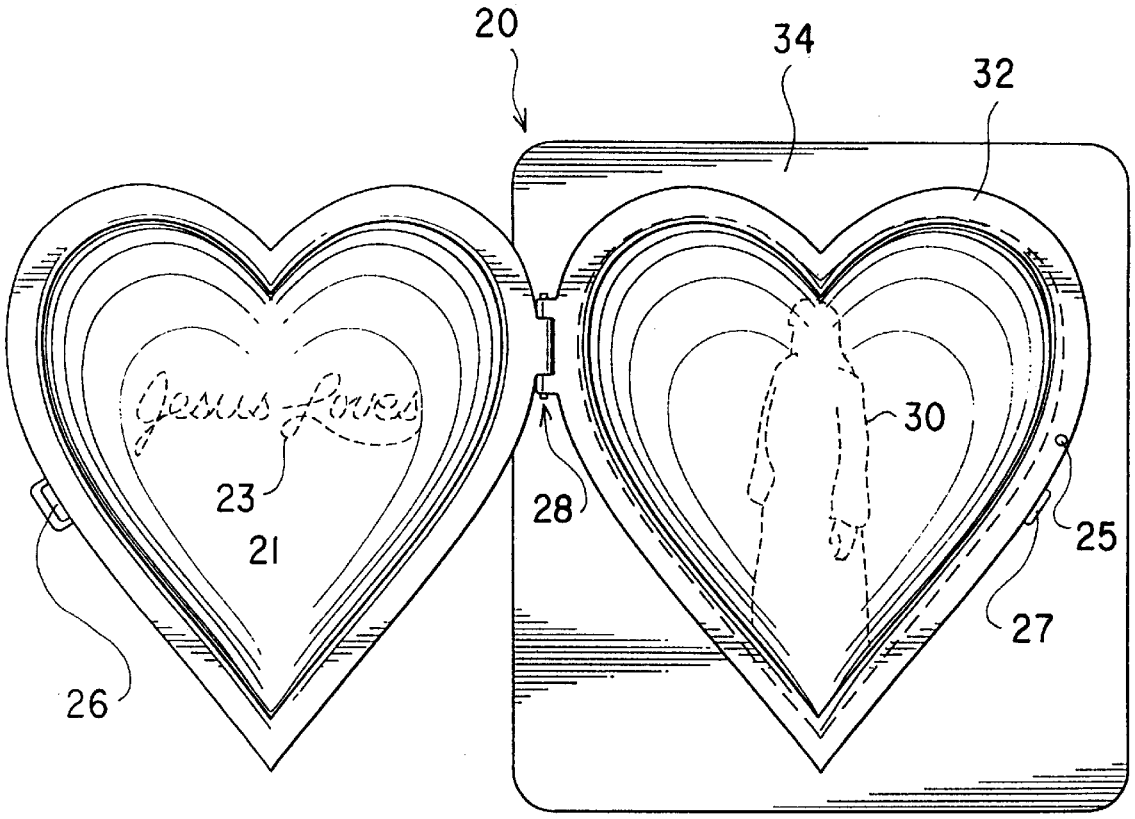
FIG. 3 is a top plan view of an open, heart shaped musical device.
Figure 4:
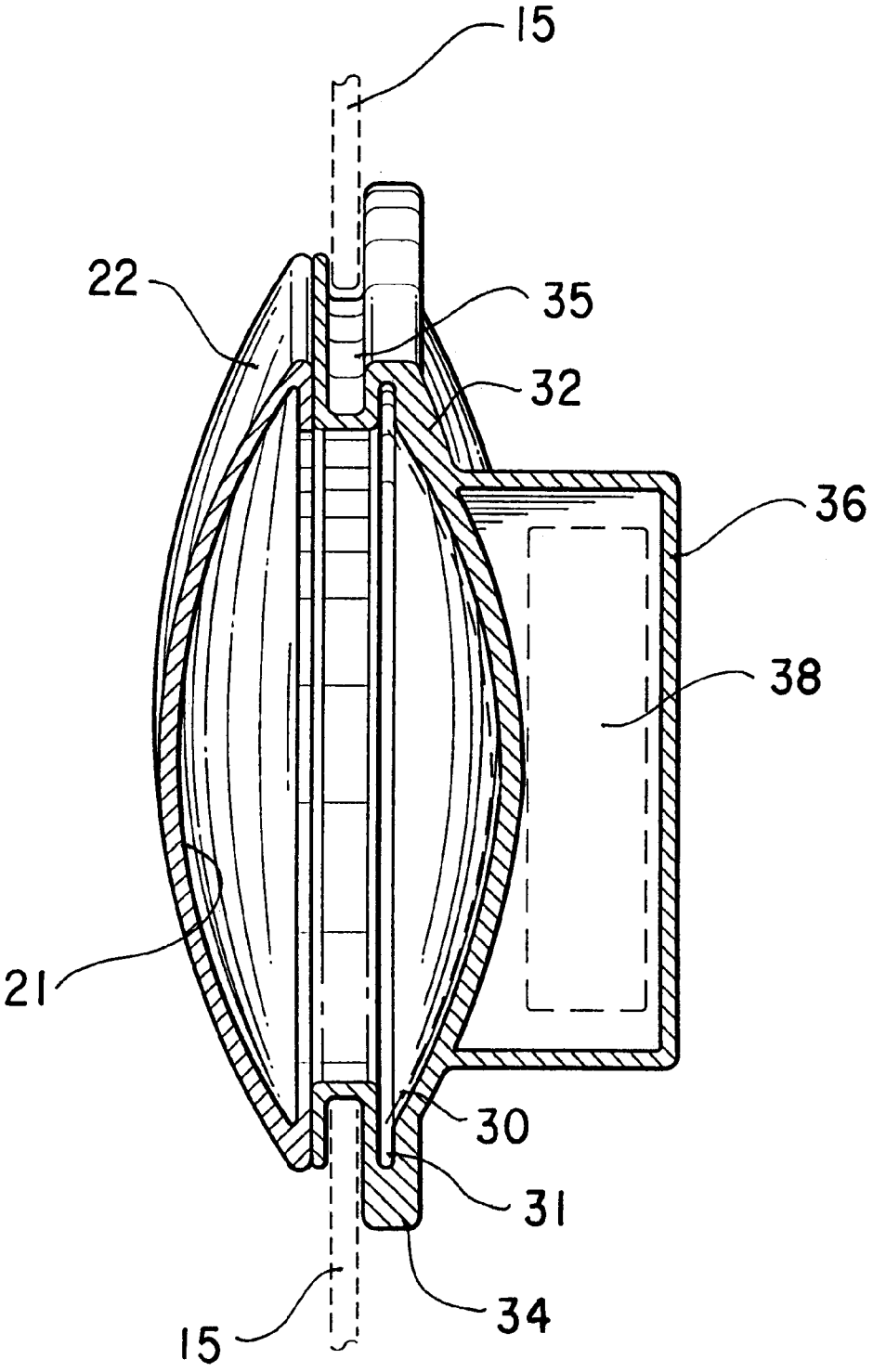
FIG. 4 is a cross sectional view of the heart shaped musical device taken along line 4—4 in FIG. 2.

Referring to FIGS. 2–4, the locket 20 includes a cover 22 that may be decoratively covered with the same material as the sash 14 as well as an optional layer of padding underneath. The cover 22 is hingedly connected to a central portion 32 of the locket which includes a flange 34 that extends about the entire perimeter of the locket. The flange 34 may be of any size which is suitable to prevent the locket 20 from being easily pulled out of or removed from the chest 15 of the doll.

Referring specifically to FIG. 3, the cover 22 is opened by lifting latch 26 thereon to displace a latch engaging spring member 27 mounted upon the central portion 34. Upon disengaging the latch 26 and spring member 27, the cover 22 may be pivoted about hinge 28. Opening the locket cover 22 reveals an interior of the central portion which may be used to store at least one picture 30 (e.g., of the intended user, etc.) and the inscription "Jesus Loves" 23 or an alternative inscription according to personal preference located on the inside or back 21 of the locket cover 22. Additionally, a switch 25 is actuated upon opening and closing of the cover 22 to activate an audio mechanism 38, as discussed hereinafter.

Referring specifically now to FIG. 4, the audio mechanism 38 is seated within an integral accessory chamber 36 located behind the central portion 32. The audio mechanism 38 is operably connected to the switch 25 and a power source with direct current (DC) such as a battery or a power source with alternating current (AC).

When the locket cover 22 is open, the switch 25 activates the audio mechanism 38 to play music such as the song or hymn "Jesus loves me". The song or hymn can be translated in various languages to provide the same effect as the English musical translation. Such modifications are considered to be well within the knowledge of one of ordinary skill in the relevant art to provide. When the cover 22 is closed, the switch opens to deactivate the audio mechanism 38. The audio mechanism 38 may either be a digital system or an analog system with a loop tape, both of which are well known in the art.

The central portion 32 includes a lateral groove 35 which allows the locket to be pressed into a heart shaped receptacle (hidden) within the pliant chest 15 of the doll. Another groove 31, internally disposed within the flange member 34, allows the picture 30 to be releasably held within the locket 20.

By providing a doll having the appearance of The Lord Jesus, and including with the doll a heart shaped locket for storing a photo of the user and an audio mechanism capable of playing uplifting music, a user may develop a certain affinity for the doll due to constant affirmation that The Lord Jesus loves the user. Use of the doll may also assist the user's psychological development or well being, regardless of whether the user is a child or an adult.

Figure 5:
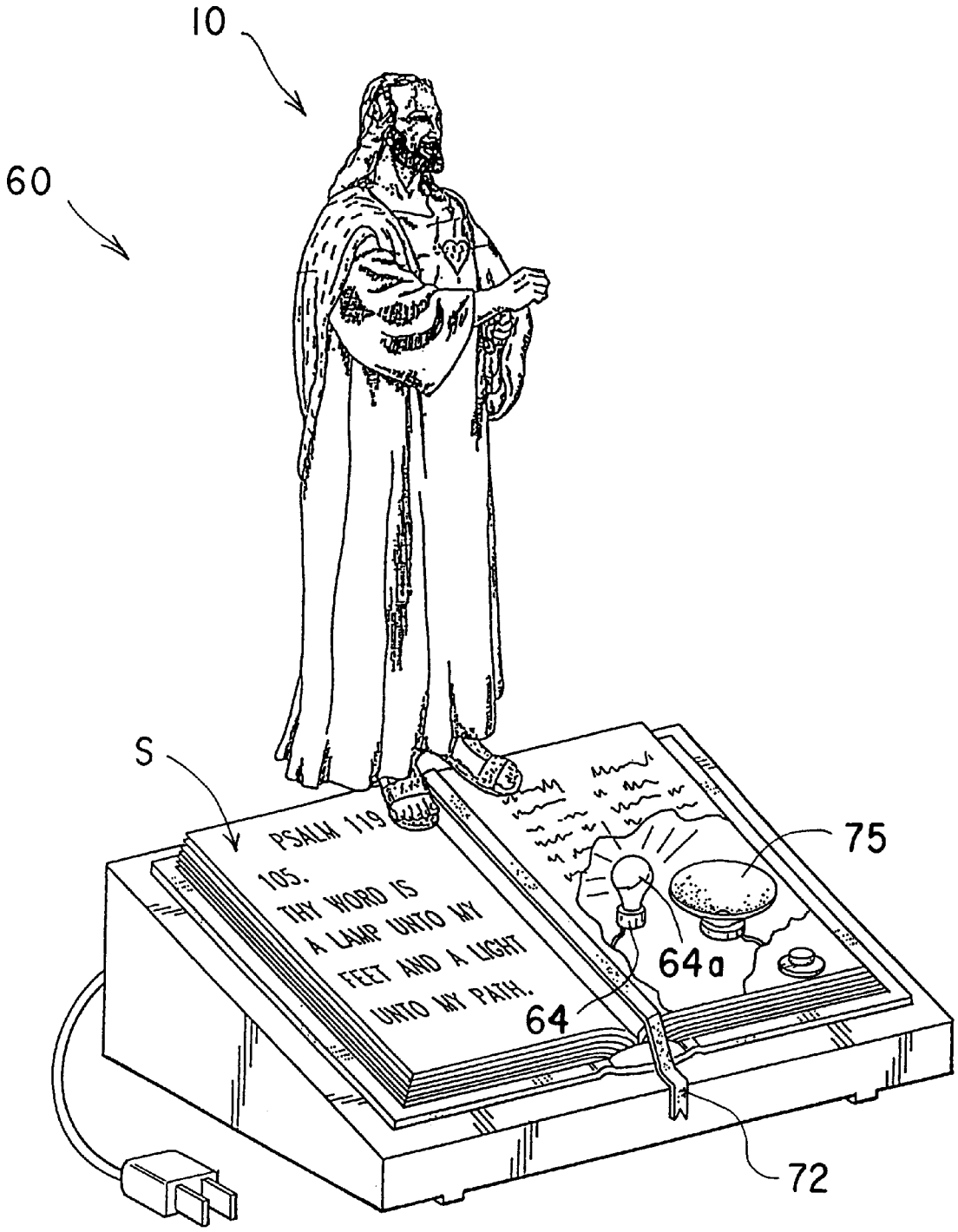
FIG. 5 is a partially fragmented, perspective view of a second embodiment of the religious doll according to the invention.
Figure 6:
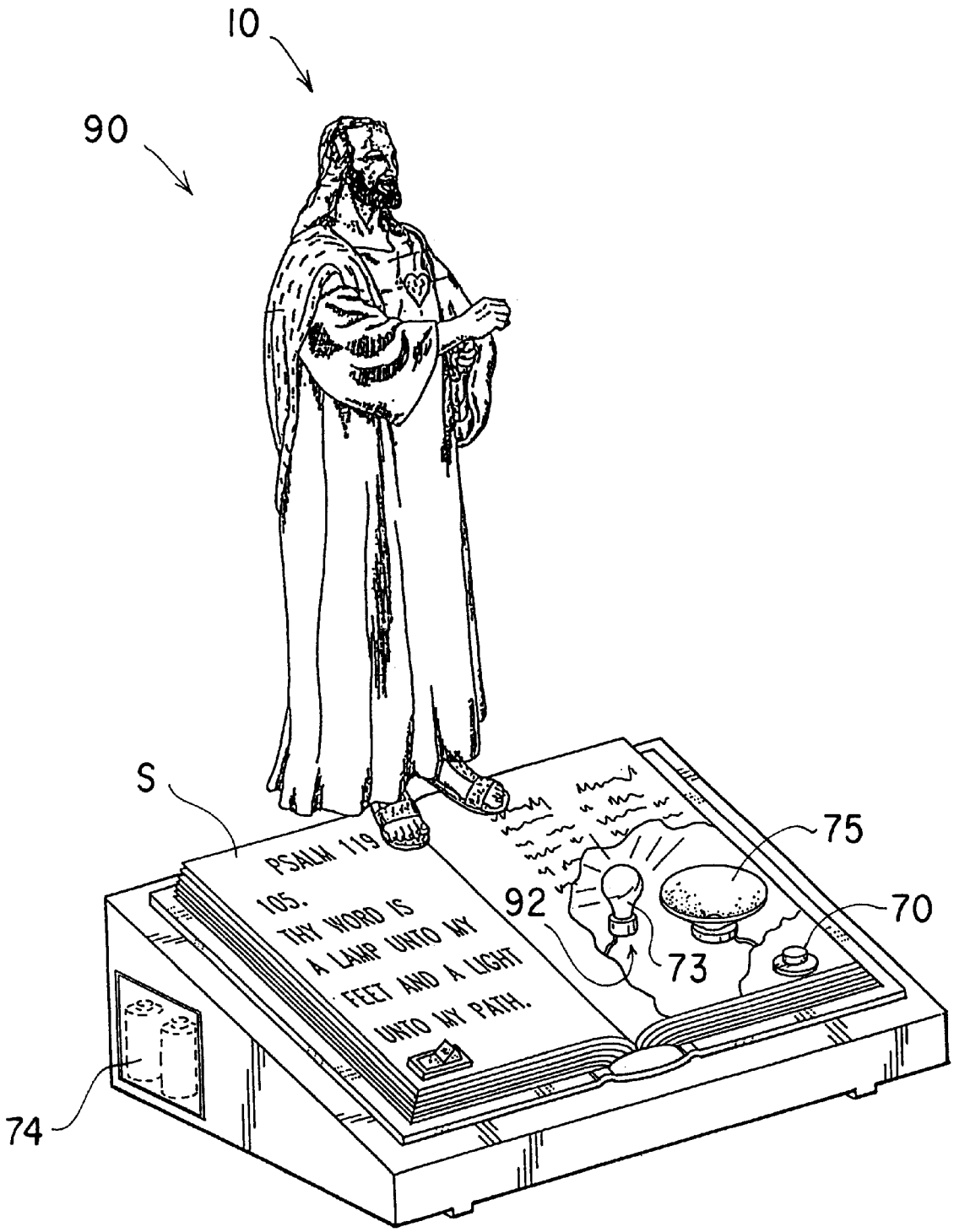
FIG. 6 is a partially fragmented, perspective view of a third embodiment of the religious doll according to the invention.

Accordingly, another embodiment of the instant invention is a combination doll 10 and nightlight or nightstand 60 and 90 as diagrammatically illustrated in FIGS. 5 and 6 respectively. As seen in FIG. 5, a doll nightlight or nightstand 60 comprises the doll 10, which is removably attached to a doll stand portion or extension 62, and a light portion 64 disposed within a central portion of the singing book or bible shown in a cut away section for providing light in a dark room or generally at night. The doll nightlight 60 also includes a pole support 66 for supporting the doll 10 on a stand 68 which is insertable to a back portion 66*b* of the singing bible 68*a*. The extension 62 of the pole support 66 serves as a branch support for removably detaching the doll 10.

The doll nightlight or nightstand 60 according to a second embodiment of the invention further includes a means 70 for activating a pre-recorded message or song within the base 68*a*. The means 70 is an activation switch for activating an audio mechanism (not shown) disposed within the base 68*a*. The audio mechanism can be a digital or analog system as recited above. The means by which the audio mechanism is activated can be by a switch 70 operated by an audible clap, push button or flip switch, and/or a mechanical hand crank, all of which are readily available to the skilled artisan to provide the desired effect as herein described.

The light portion 64 also includes a light bulb or filament 64*a* and a insulator cover 64*b* (not shown) for reducing heat transfer from the bulb 64*a* to the surface S. The book mark 72 functions as a switch for turning on and off the light 64*a*. The switch 72 can provide three separate levels of power corresponding to three different intensities as a matter of design preference. The light 64*a* is preferably powered by standard household 120 Volt (AC) power. Depending on the user needs, the nightlight may be adapted to use power by battery or a direct current source 74 as shown in FIG. 6. The provision for the use of a battery or direct current source 74 allows a user to carry the device without the limitation of a fixed alternating current power source.

As best seen in FIG. 6, the battery operated combination doll nightlight or nightstand 90 comprises the base 68*a* including the switch 70. The base 68*a* further includes a light portion 92 and a doll stand 66 separately and insertably connected to the base the base 68*a* via slot 66*b*. Both the doll 10 and pole support 66 having a base 68 are removably connected via the extension support 62 and is insertably attached to the singing bible 68*a* as a single unit. The removable feature of the doll stand 66 form the singing bible is diagrammatically illustrated in FIG. 7 as separate entities.

Any mechanical fastening method (i.e screws, bolts, etc.) can be used to secure the base 68 to the singing bible 68*a* so long as the choice of mechanical fastener provides the required structural stability for the proper functioning of the instant invention. The light portion 92 further includes a switch 71 which turns on and off a low powered bulb 73 which provides sufficient light for reading an illuminated inscription (i.e. PSALM 119:105 "THY WORD IS A LAMP UNTO MY FEET AND A LIGHT UNTO MY PATH.") made on the top surface S of the base 68. The advantage of this embodiment of the instant invention is that the combination doll nightlight can be carried and used virtually anywhere (eg. a camping retreat, special meetings, etc.) without the need for AC power. In the event such power is needed, however, an adapter (not shown) can be used to provide the necessary power for providing light for a user.

Figure 7:
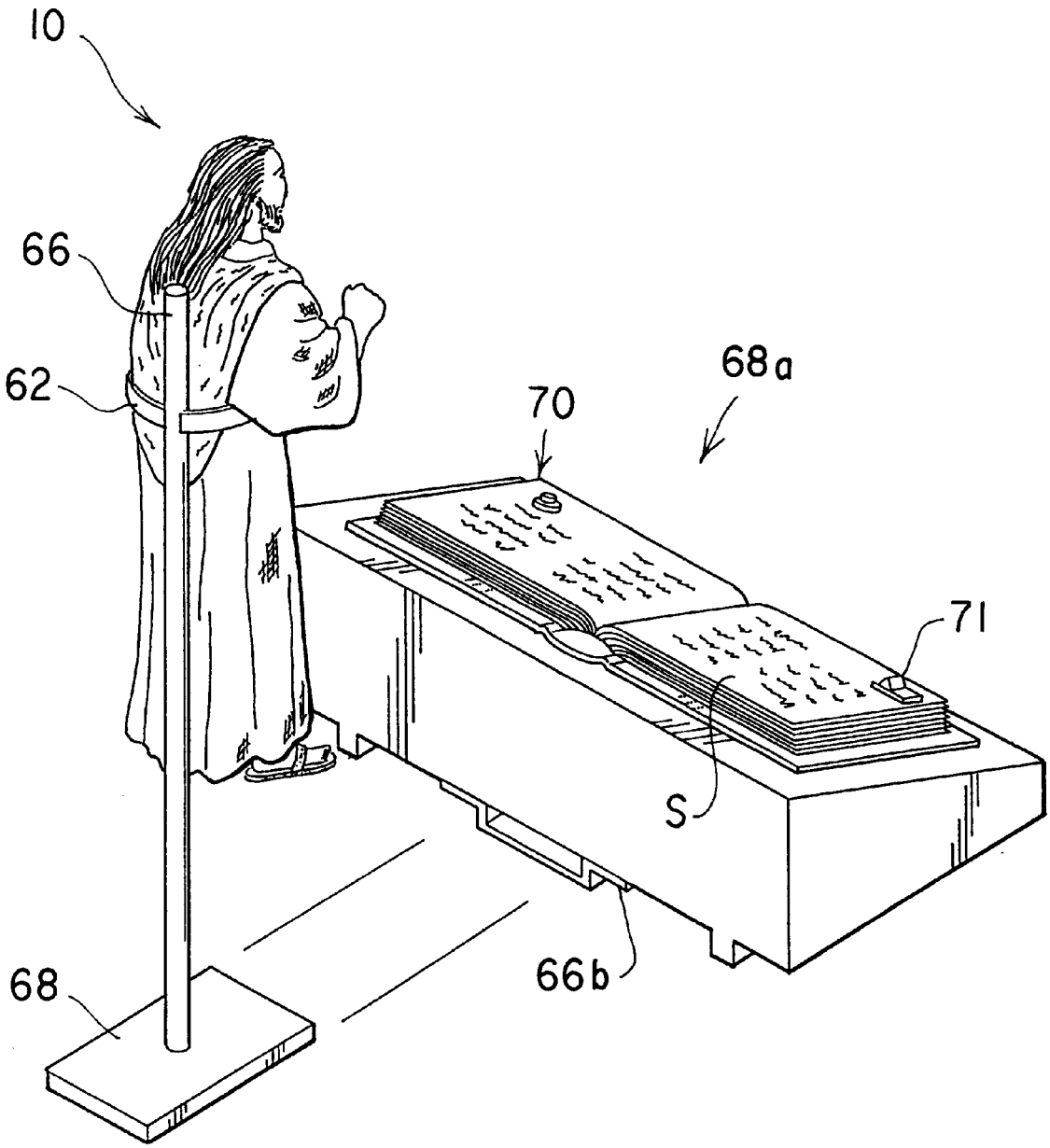
FIG. 7 is a rear, perspective view of the musical religious doll and singing bible nightlight, illustrating the insertable doll stand.

According to the preferred embodiment the doll 10 and singing bible 68*a* are made of porcelain or plastic material. The doll 10 can also be made of vinyl. The supports for the doll stand 66 as seen in FIG. 7 is preferably metallic (eg. copper, brass, stainless steel, etc.). The choice of the type of metal is primarily dependent upon the aesthetic preference of a user. One of ordinary skill in the art would need only to perform routine skill in the art to provide the desired result.

The switch 70 as recited above activates a pre-recorded message from a audio mechanism 75 partially shown. Also, the doll 10 in both embodiments of FIGS. 5, 6 and 7 is removably attached to the respective stands.

It is to be understood that the present invention is not limited to the sole embodiment described above, but encompasses any and all embodiments within the scope of the following claims.

I claim:

1. A doll nightlight comprising:

a nightlight in combination with a doll, said doll having a body portion with a receptacle formed in said body portion;

a heart shaped locket having a central portion and a cover hingedly connected to said central portion, said central portion including a lateral flange and an annular groove intermediate said lateral flange and said cover;

said heart shaped locket being inserted into said body portion with said lateral flange being inserted into said receptacle with said body portion overlaying said lateral flange and engaging said annular groove;

an audio mechanism operably connected to a power source, said audio mechanism being mounted upon said locket;

a switch operable upon manipulation of said cover to activate and deactivate said audio mechanism;

a base in the form of an open book;

said base having a light portion for containing a light bulb; and a stand portion for holding the doll.

2. The doll nightlight according to claim 1, wherein said base further comprises a light switch for turning on and off the light of said light portion.

3. The doll nightlight according to claim 2, wherein the base is a porcelain wedge-shaped base.

4. The doll nightlight according to claim 2, wherein the base is a plastic wedge-shaped base.

5. The doll nightlight according to claim 2, wherein the base further comprises an inscription from a passage from the Bible.

6. The doll nightlight according to claim 2, wherein the base further comprises a means for activating a pre-recorded message.

7. The doll nightlight according to claim 2, wherein said light portion and doll stand are separately and integrally attached to the base.

8. The doll nightlight stand according to claim 2, wherein said light portion is powered by a battery.

9. The doll nightlight according to claim 2, wherein said light portion is powered by an alternating current source.

10. The doll nightlight according to claim 1, wherein said doll is removably attached to said stand.

11. The doll nightlight according to 2, wherein said switch is made in the form of a book mark, said switch for turning on and off said light of the light portion.

* * * * *